US007145094B2

(12) United States Patent
Oexle et al.

(10) Patent No.: US 7,145,094 B2
(45) Date of Patent: Dec. 5, 2006

(54) SYSTEM AND METHOD FOR PROCESSING FLAT MAILINGS

(75) Inventors: Dietmar Oexle, Singen (DE); Armin Zimmermann, Constance (DE)

(73) Assignee: Siemens AG, München (DE)

( * ) Notice: Subject to any disclaimer, the term of this patent is extended or adjusted under 35 U.S.C. 154(b) by 219 days.

(21) Appl. No.: 10/995,119

(22) Filed: Nov. 24, 2004

(65) Prior Publication Data

US 2005/0194294 A1 Sep. 8, 2005

Related U.S. Application Data

(63) Continuation of application No. PCT/DE03/01354, filed on Apr. 25, 2003.

(30) Foreign Application Priority Data

May 25, 2002 (DE) ..... 102 23 348

(51) Int. Cl.
*B07C 5/00* (2006.01)

(52) U.S. Cl. ..... 209/584; 209/900

(58) Field of Classification Search ..... 209/584, 209/900; 198/357, 349.6, 363, 448
See application file for complete search history.

(56) References Cited

U.S. PATENT DOCUMENTS 6,059,091 A * 5/2000 Maier et al. ..... 198/349.6
6,082,521 A * 7/2000 Maier et al. ..... 198/349.6
6,513,641 B1 * 2/2003 Affaticati et al. ..... 198/357

FOREIGN PATENT DOCUMENTS

| | | |
|---|---|---|
| DE | 3723259 A1 | 1/1989 |
| DE | 1982948 C1 | 11/1999 |
| EP | 0834354 A1 | 4/1998 |
| EP | 0853984 A1 | 7/1998 |
| WO | WO 97/31726 | 9/1997 |
| WO | WO01/30514 A1 | 5/2001 |

OTHER PUBLICATIONS

Derwent Abstract—DE3723259A1; Jan. 26, 1989; Licentia Patent-Verwaltungs-GmbH, D-6000 Frankfurt (Germany).
Derwent Abstract—DE19829484C1; Nov. 11, 1999; Siemens AG, D-80333 München (Germany).

* cited by examiner

*Primary Examiner*—David H. Bollinger
(74) *Attorney, Agent, or Firm*—Siemens AG

(57) ABSTRACT

The invention relates to a method and a device for processing flat mailings, according to which two or more piles of mailings, the destination addresses of which are known and which are sorted according to the distribution order, are separated by a separating device, are directed onto a common transport path, and are then jointly stacked in the order in which the mailing have been transported. The separation process is timed in such a way that the joined mailings are transported on the transport path in the order in which they are to be distributed based on the known destination addresses. A unit detecting the destination addresses on the mailings and a sensor arrangement detecting the leading an trailing edges of the mailings are disposed along the transport path.

23 Claims, 4 Drawing Sheets

SYSTEM AND METHOD FOR PROCESSING FLAT MAILINGS

CROSS REFERENCE TO RELATED APPLICATIONS

The present application is a continuation of international application PCT/DE03/01354, filed on 25 Apr. 2003, which designated the United States and was pending at the time of designation and the filing of the present application; and further claims priority to German patent application 10223348.9, filed May 25, 2002; the both of which are herein incorporated by reference.

BACKGROUND OF THE INVENTION

During the automatic sorting of flat mailings in distribution order on a sorting machine in a plurality of passes, in the normal case all the mailings to be distributed by the mailman on one day have to be put one after another into the sorting machine. However, a relatively large time window is needed for this. If this is not available, then some of the mailings supplied must already previously be sorted in distribution order and then the sorting of the remainder of the mailings supplied in distribution order is carried out. The two pre-sorted stacks are then combined to form a single stack sorted in the distribution order. For this purpose, each stack is separated again. The separation is carried out in such a way that the mailings led together in a transport stream are transported in the distribution order. This transport stream opens into a stacking device in which, by means of continuous scanning, one or more part stacks with mailings in the distribution order are produced.

As a result of separation errors, for example double extractions, or erroneous mailings, the extraction sequence predefined on the basis of the known destination addresses of the pre-sorted stacks can lead to wrong orders in the combined mailing stream and the entire following stack section.

This erroneous sorting can be detected by using a detection unit, arranged on the transport path after the separating devices, in order to determine the destination addresses. The wrongly allocated mailings are then sorted into a special compartment and then have to be sorted manually into the stack produced.

In order that as few mailings as possible are sorted into the special compartment as wrongly allocated, the detection unit should be arranged as close as possible to the separating device. However, this is possible only to a restricted extent, since an alignment section must always be located upstream of an economical detection unit, that is to say the minimum distance between separating device and detection unit is approximately 2 m. The result of this in turn is that, when a fault is detected, the mailings already located in the alignment section can no longer be influenced and have to be inserted manually into the sorted stack, which is costly and time-consuming.

SUMMARY OF THE INVENTION

The invention is therefore based on the object of providing a method and an apparatus in which two or more stacks of mailings sorted in distribution order, whose destination addresses are known, are led together in the distribution order in a transport path and are then stored together, and with the aid of which, in the event of separation errors or erroneous mailings, the number of mailings to be fitted manually into the sorted stack is reduced.

After the detection unit on the common transport path and the sensor arrangement detecting the mailing edges, the mailings are divided up via a diverter to two subsequent transport paths, which are led together again at their ends. At least one of the two subsequent transport paths has a braking/accelerating module. If the detection unit determines a transposed order of the mailings, then the corresponding mailings following one another before the diverter are displaced with respect to one other in the mailing stream in such a way that, after being led together, the mailings are transported onward in the correct order to be stacked, while maintaining a minimum gap between the mailings. As a result, mailings with a transposed order no longer have to be sorted manually like the double extractions and erroneous mailings.

Thus, in order to maintain the smallest possible gaps between the mailings, it is advantageous if there are braking/accelerating modules in both the subsequent transport paths. In one transport path, in the event of a transposed order, the mailing respectively leading in the mailing stream is displaced rearward in the mailing stream by means of a braking/accelerating module located there and, in the other transport path, the respectively following mailing is displaced forward by the braking/accelerating module located there. In order to assist the displacement forward, the appropriate subsequent transport path is advantageously shorter than the transport path for the mailings to be displaced rearward. As a result, the corresponding mailings are already displaced forward by the amount of the difference in length.

If a reduced-cost variant is to be implemented, then it is advantageous if the subsequent shorter transport path for the mailings to be displaced forward is designed without a braking/accelerating module. In order that no overlaps result during displacement in this case, the necessary gap $L_{erf}$ must be correspondingly larger than the minimum gap $L_{min}$. The result is therefore that the necessary gap $L_{erf}=0.5*(2*L_{min}+S_{max}-S_{min})$ where $S_{max}$=maximum length of a mailing $S_{min}$=minimum length of a mailing.

BRIEF DESCRIPTION OF THE SEVERAL VIEWS OF THE DRAWINGS

In the following text, the invention will be explained in more detail in an exemplary embodiment, using the drawing, in which.

DETAILED DESCRIPTION OF THE INVENTION

Figure 1:
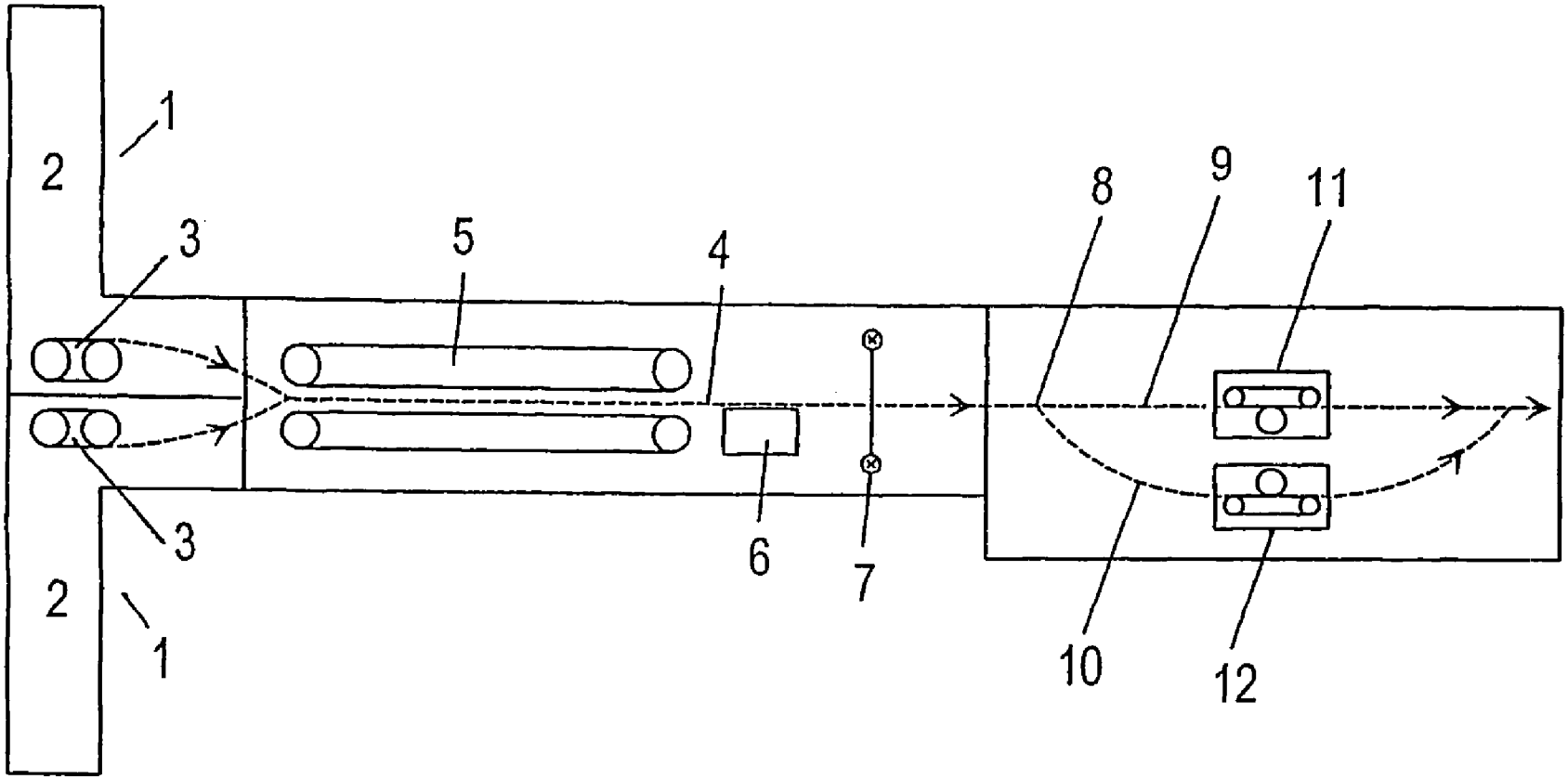
FIG. 1 shows a schematic plan view of a device for the correct-sequence combination of two stacks of mailings sorted in distribution order.

For each of the two stacks of flat mailings sorted in distribution order, a material input 1 is provided. The mailings are placed on the respective feeder bed 2 and transported to the separating device 3 by means of an underfloor belt and a support which is coupled detachably to the latter and holds the stack upright. These separating devices 3 pull off the respective foremost mailing from the stack and convey it via a junction into a transport path 4, which is constructed as a covering belt system. Integrated into the transport path 4 is an aligning station 5, in order that the mailings pass a subsequent detection unit 6, with which the destination addresses on the mailings are read, in a defined aligned position. The transport path 4 is then followed by a sensor arrangement 7, designed as a light barrier, for the detection of the leading and trailing edges of the mailings, in order that the switching times of a diverter 8 and the controlled sequences of braking/accelerating modules 11, 12 can be defined by the control system, while preserving the defined minimum gaps between the mailings before being stacked. This transport path 4 is followed via the diverter 8 by two subsequent transport paths 9, 10, which each have a braking/accelerating module 11, 12. In each braking/accelerating module 11, 12, mailings can be displaced rearward in the mailing stream as needed by means of braking and, if appropriate, stopping, or displaced forward in the mailing stream as needed by acceleration, limits being placed on the displacement forward. In order to displace this limit, the transport path 11 in which the mailings are displaced forward is designed to be shorter than the other transport path 12. The two transport paths 11, 12 are combined via a junction.

Figure 2:
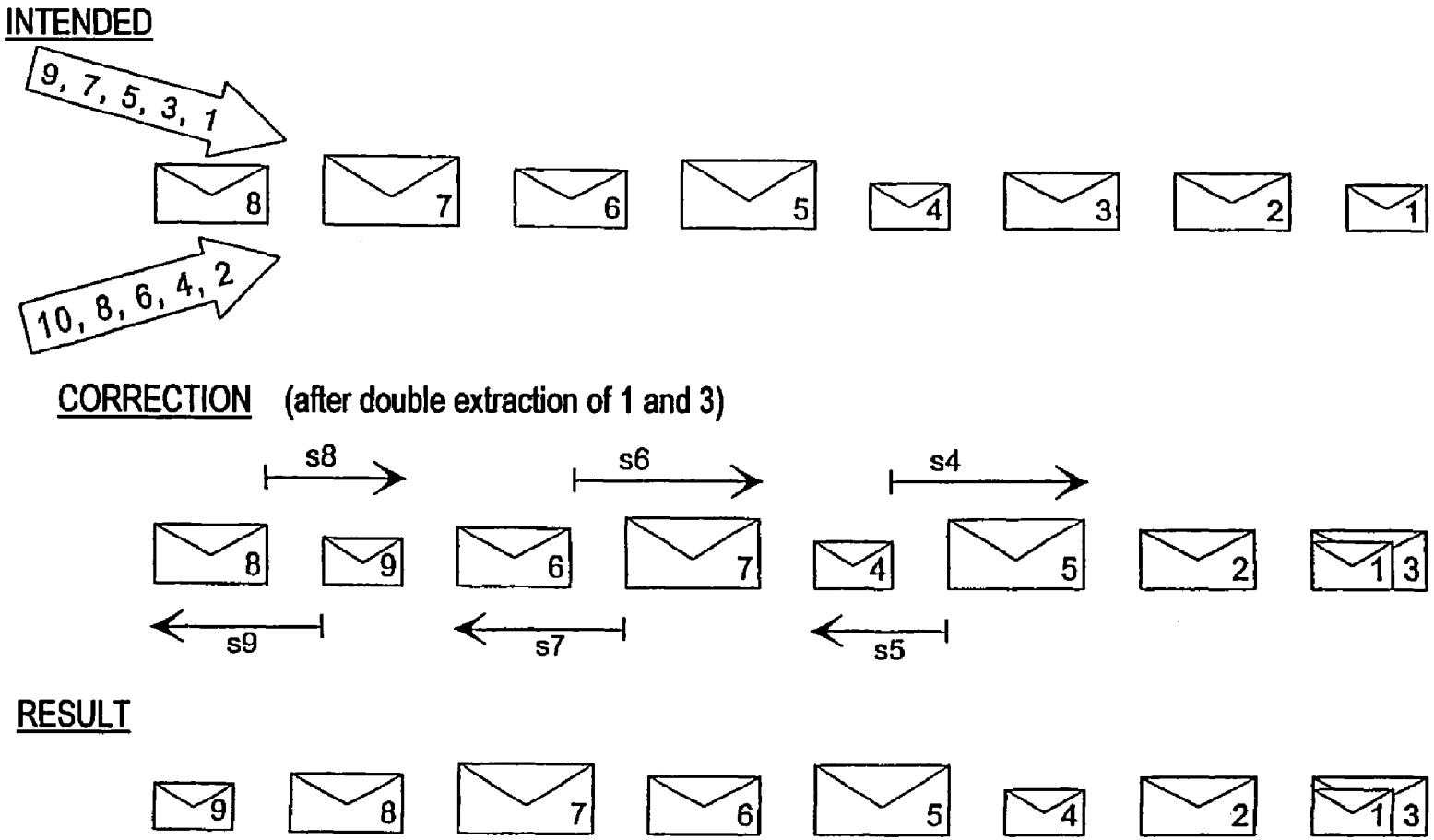
FIG. 2 shows a schematic illustration of the displacement process for correcting the erroneous sorting following a double extraction, with two braking/accelerating modules.
Figure 3:
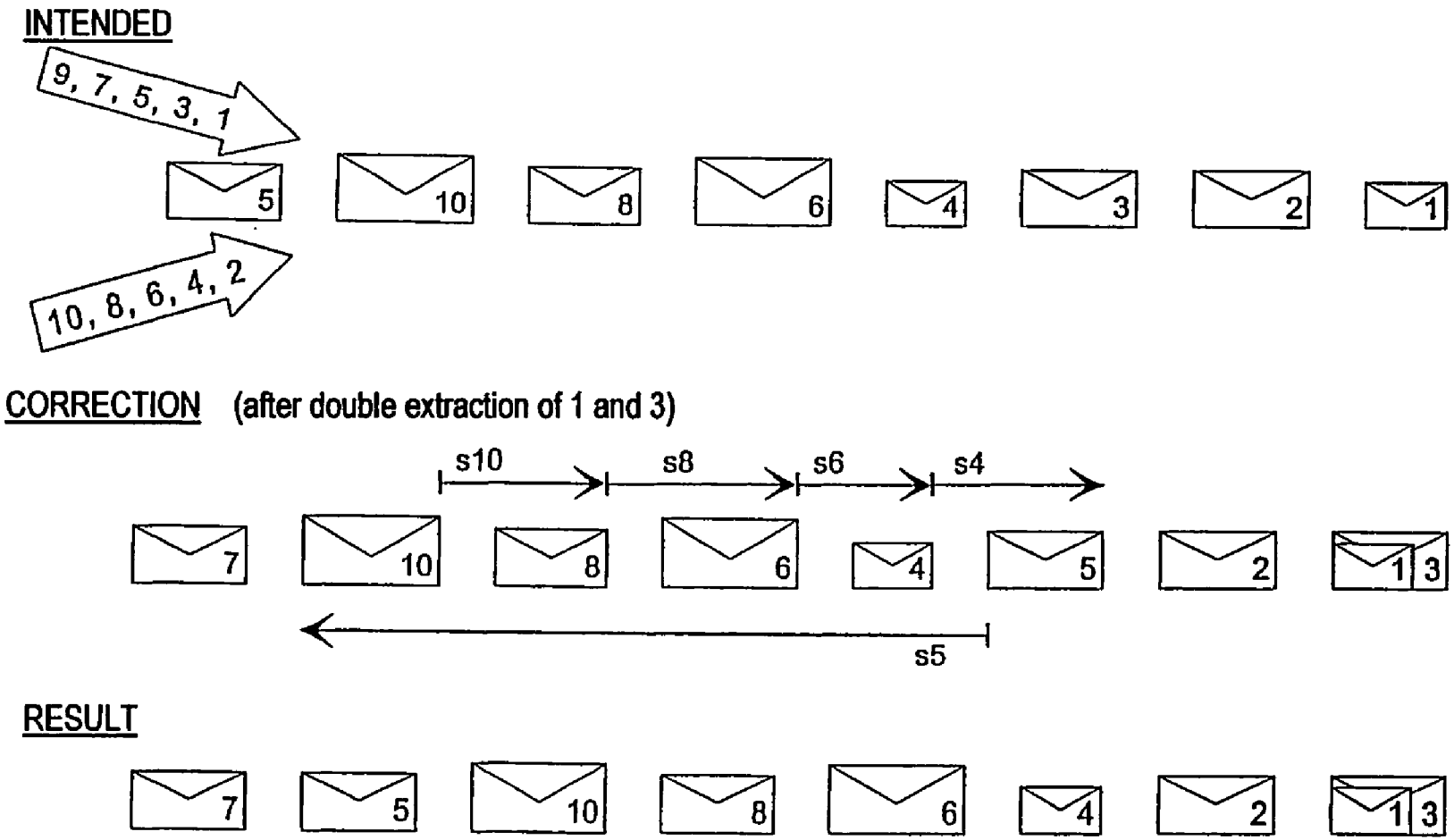
FIG. 3 shows a schematic illustration of the displacement process in the case of a plurality of extractions one after another from a stack having two braking/accelerating modules.
Figure 4:
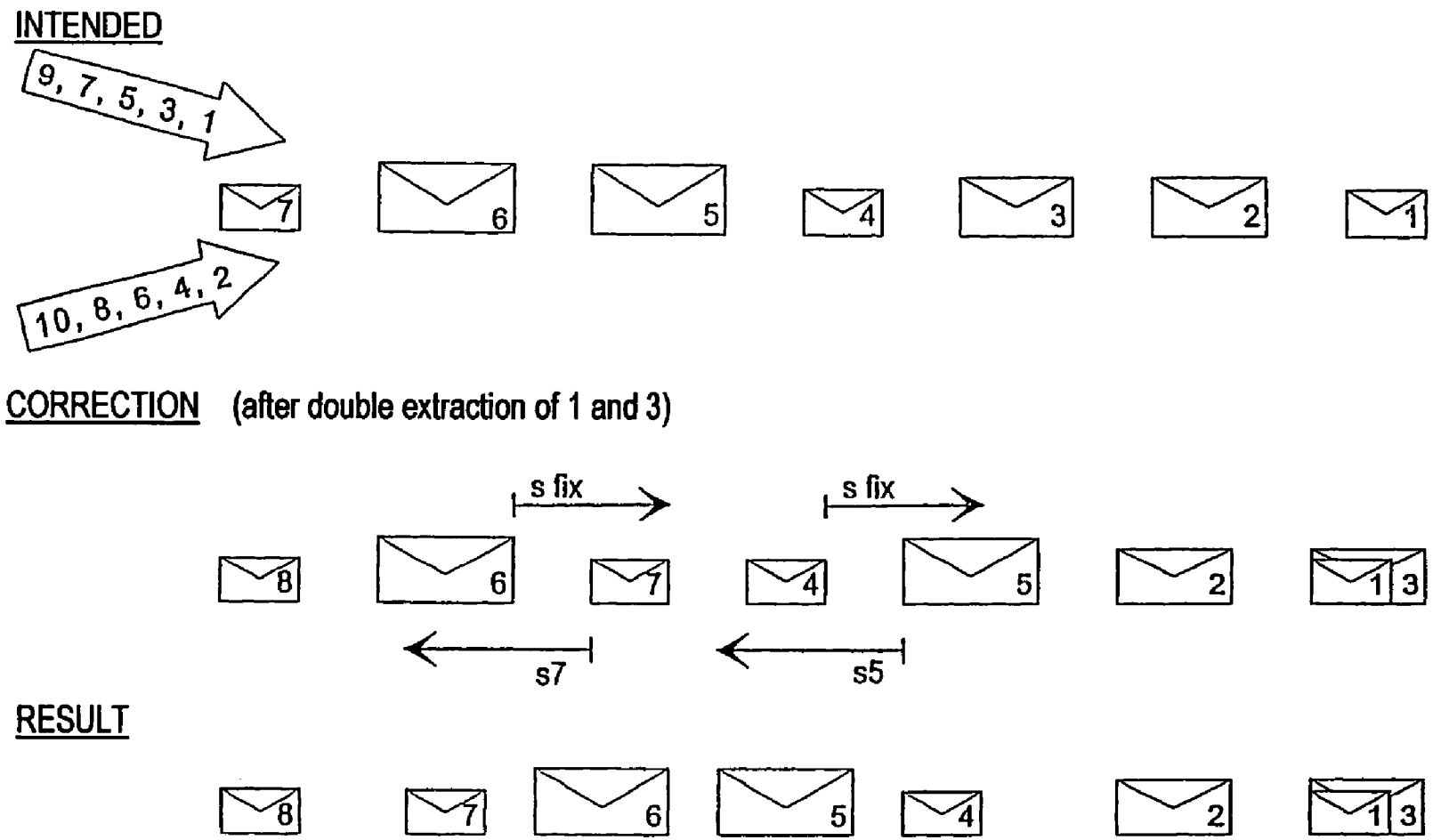
FIG. 4 shows a schematic illustration of the displacement process with one braking/accelerating module.

The displacement process is illustrated in more detail in FIGS. 2–4.

In FIGS. 2 and 4, "intended" indicates, with the arrows and the numbers found in them, the order in which the two stacks have to be separated on the basis of the intended destination addresses notified, that is to say first of all the foremost mailing "1" from the upper stack, then the foremost mailing "2" from the lower stack, then the following mailing "3" from the upper stack and so on. In the case of proper separation sequences, the order illustrated would result in the mailing stream.

However, if the first two mailings "1" and "3" are pulled off from the upper stack together as a double extraction, then, on the basis of the known intended information with respect to the destination addresses, further separation would be carried out, as illustrated under "correction". If this double extraction is diagnosed, the ten mailings illustrated (FIG. 2) are already in the transport path, that is to say, as can be seen, all the mailings extracted would have to be inserted manually later, since they are not in the distribution order in the mailing stream. If, however, by means of displacement, appropriate interchanges are carried out, the result is the mailing stream illustrated under "result", and only the double extraction (mailings "1" and "3") has to be removed and fitted in manually. The displacement is carried out in such a way that the mailings to be displaced forward are displaced by the minimum gap plus the length of the mailing placed in front of it before the displacement, and the mailings to be displaced rearward are displaced by the minimum gap plus the length of the mailing placed behind it before the displacement.

In FIG. 3, this sequence is illustrated with the special feature that four mailings "4, 6, 8, 10" from the lower stack are to be extracted one after another on the basis of the intended information relating to the destination addresses.

If the first two mailings "1, 3" from the upper stack are pulled off again as a double extraction, then the mailings are separated on the basis of the intended order, as illustrated under "correction". In order to arrive at the correct order, the displacement forward of the four mailings "4, 6, 8, 10" is carried out as described in FIG. 2, only one mailing "5" must be displaced back into the gap in front of the mailing "7" (by means of appropriately long stopping in the braking/accelerating module).

The illustration of the order of the mailings after the displacement process in "result" reveals that, after the double extraction "1, 3," all the mailings are in the correct order in accordance with the "intended" specifications.

FIG. 4 illustrates the displacement sequence if a braking/accelerating module for the displacement rearward is arranged only in one subsequent transport path and, in order to implement a constant displacement $S_{fix}$ forward, the other transport path is correspondingly shorter than the transport path equipped with the braking/accelerating module.

The constant displacement forward $s_{fix}$ is given by $L_{erf}+S_{min}$, where $L_{erf}$=required gap between the mailings when extracted.

$S_{min}$=minimum length of a mailing, the required gap $L_{erf}$ being enlarged with respect to the minimum gap $L_{min}$ in accordance with the relationship $$L_{erf}=0.5*(2*L_{min}+S_{max}-S_{min}).$$

($S_{max}$=maximum length of a mailing).

The displacement of the long mailing "5" rearward is $s_5=L_{min}+S_{max}(S_{max}=s_5)$ and of the short mailing "7" rearward is $s_7=S_{max}+L_{erf}$ ($S_{max}+L_{min}$ would also be admissible)

In order to somewhat reduce the loss in throughput with such an arrangement, there is the possibility of producing the extraction gap as a function of the length of the leading mailing.

Processing more than two stacks of mailings is carried out in an analogous manner which is clear to those skilled in the art and therefore does not need to be described in more detail.

The invention claimed is:

1. A method of processing mail items, said items being sorted into a plurality of stacks and comprising known destination addresses, said method comprising the steps of:

separating said mail items with a separating device;

directing said mail items into a common transport path;

stacking said mail items together in a transport order;

timing said step of separating such that said mail items are transported in said transport path in distribution order according to said destination addresses;

detecting said destination addresses with a detection unit;

detecting leading and trailing edges of said mail items when said mail items are in said transport path with a sensor unit;

diverting said mail items at a diverting location among two transport paths said paths merging at a merge location downstream from said diverting location, and at least one of said paths comprising a breaking/accelerating module arranged so as to cause a change from a first to a second order of mail items, said first order defined upstream of said diverting location and said second order defined downstream of said merge location.

2. The method according to claim 1, further comprising the steps of determining a desired second order based upon said destination addresses.

3. The method according to claim 2, further comprising the step of comparing said desired second order with said first order and if said first order is different causing said mail items to be arranged in said second order.

4. The method according to claim 1, wherein said mail items are selectively spaced.

5. The method according to claim 1, further comprising the step of breaking a leading mail piece and accelerating a trailing mail piece so as to cause said trailing mail piece to overtake said leading mail piece, said breaking occurring along said paths.

6. The method according to claim 5, wherein a first of said paths is assigned to breaking and a second of said paths is assigned to accelerating, and wherein said second path is shorter than said first path.

7. The method according to claim 6, wherein said second path comprises no breaking/accelerating unit and a minimum gap $L_{erf}$ between mail items is defined by the relationship: $L_{erf}=0.5*(2*L_{min}+S_{max}-S_{min})$, wherein $L_{min}$=minimum gap, $S_{max}$=maximum length of a mailing, and $S_{min}$=minimum length of a mailing item.

8. The method according to claim 1, wherein said mail items are flat mail items.

9. A method of processing mail items, comprising the step of:

diverting said mail items at a diverting location among two transport paths said paths merging at a merge location downstream from said diverting location, wherein at least one of said paths comprises a breaking/accelerating module arranged so as to cause a change from a first to a second order of mail items, said first order defined upstream of said diverting location and said second order defined downstream of said merge location.

10. The method according to claim 9, wherein at least one of said first and second orders is based upon destination addresses of said mail items.

11. The method according to claim 9, wherein said paths comprise an accelerating path and a breaking path, said accelerating path being shorter than said breaking path.

12. The method according to claim 9, wherein a distance between said mail items is defined by the relationship: $L_{erf}=0.5*(2*L_{min}+S_{max}-S_{min})$, wherein $L_{min}$=minimum gap, $S_{max}$=maximum length of a mailing, and $S_{min}$=minimum length of a mailing item.

13. The method according to claim 9, wherein said mail items are flat mail items.

14. A system for processing mail items, comprising:

means for sequencing said mail items in a mailing stream, a transporter unit for transporting said mail items in a first order along a first path, a detection unit for detection destination addresses of said mail items, said detection unit comprising means for determining if said first order corresponds to a desired delivery sequence of said mail items, said delivery sequence corresponding with said destination addresses, and a diverter arranged downstream of said transporter unit, said diverter arranged to divert said mail items among a second and third path, said second path comprising a mail item acceleration path and said third path comprising a mail item breaking path, said second and third path merging into a common path downstream from said diverter unit such that mail items are arranged in a second order on said common path, said second order corresponding substantially similar or better to said delivery sequence than said first order.

15. The system according to claim 14, further comprising at least one of an accelerating unit arranged on said accelerating path and a breaking unit arranged on said breaking path.

16. The system according to claim 14, wherein said accelerating path is shorter than said breaking path.

17. The system according to claim 15, wherein said accelerating path is shorter than said breaking path.

18. The system according to claim 14, wherein spacing between mail items in said second order is defined by the relationship: $L_{erf}=0.5*(2*L_{min}+S_{max}-S_{min})$, wherein $L_{min}$=minimum gap, $S_{max}$=maximum length of a mailing, and $S_{min}$=minimum length of a mailing item.

19. The system according to claim 14, wherein said mail items are flat mail items.

20. An apparatus for handling mail items comprising means diverting said mail items at a diverting location among two transport paths said paths merging at a merge location downstream from said diverting location, wherein at least one of said paths comprises a breaking/accelerating module arranged so as to cause a change from a first to a second order of mail items, said first order defined upstream of said diverting location and said second order defined downstream of said merge location.

21. The apparatus according to claim 20, wherein at least one of said first and second orders is based upon destination addresses of said mail items.

22. The apparatus according to claim 20, wherein said paths comprise an accelerating path and a breaking path, said accelerating path being shorter than said breaking path.

23. The apparatus according to claim 20, wherein a distance between said mail items is defined by the relationship: $L_{erf}=0.5*(2*L_{min}+S_{max}-S_{min})$, wherein $L_{min}$=minimum gap, $S_{max}$=maximum length of a mailing, and $S_{min}$ =minimum length of a mailing item.

* * * * *